US012569903B2

(12) United States Patent
Suzuki

(10) Patent No.: US 12,569,903 B2
(45) Date of Patent: Mar. 10, 2026

(54) PLATE MATERIAL SUPPLYING APPARATUS

(71) Applicant: SANKYO SEISAKUSHO CO., Tokyo (JP)

(72) Inventor: Kengo Suzuki, Kikugawa (JP)

(73) Assignee: SANKYO SEISAKUSHO CO., Tokyo (JP)

( * ) Notice: Subject to any disclaimer, the term of this patent is extended or adjusted under 35 U.S.C. 154(b) by 893 days.

(21) Appl. No.: 17/426,774

(22) PCT Filed: Feb. 3, 2020

(86) PCT No.: PCT/JP2020/003951
§ 371 (c)(1),
(2) Date: Jul. 29, 2021

(87) PCT Pub. No.: WO2020/162404
PCT Pub. Date: Aug. 13, 2020

(65) Prior Publication Data

US 2022/0097119 A1 Mar. 31, 2022

(30) Foreign Application Priority Data

Feb. 4, 2019 (JP) ..... 2019-018148

(51) Int. Cl.
*B21D 43/02* (2006.01)
*B65H 20/24* (2006.01)

(52) U.S. Cl.
CPC ..... *B21D 43/02* (2013.01); *B65H 20/24* (2013.01)

(58) Field of Classification Search
CPC .... B21D 43/02; B21D 43/022; B21D 43/023; B65H 20/24
(Continued)

(56) References Cited

U.S. PATENT DOCUMENTS 3,762,198 A * 10/1973 Bair ..... B21D 43/022 72/28.2
3,817,067 A 6/1974 Voorehes et al.
(Continued)

FOREIGN PATENT DOCUMENTS

JP H02-108415 A 4/1990
JP H06-005716 U 1/1994
(Continued)

OTHER PUBLICATIONS

Matsumoto; Tadashige, "Coil Material Feeder For Thin Plate of High-Speed Press" (English Translation), Jun. 2, 2011, worldwide.espacenet.com (Year: 2011).*
(Continued)

*Primary Examiner* — Molly K Devine
(74) *Attorney, Agent, or Firm* — Harness, Dickey & Pierce, P.L.C.

(57) ABSTRACT

Provided is a plate material supplying apparatus that can supply a plate material to a plate material feeding device that intermittently conveys a plate material. The plate material supplying apparatus includes: an upper part that conveys a plate material substantially in a direction of a plate material feeding device; a central part that receives the plate material conveyed from the upper part and conveys the plate material in an obliquely vertical downward direction; and a lower part that receives the plate material conveyed from the central part and conveys the plate material substantially in the direction of the plate material feeding device.

6 Claims, 6 Drawing Sheets

(58) Field of Classification Search
USPC ..... 226/24
See application file for complete search history.

(56) References Cited

U.S. PATENT DOCUMENTS

| | | | | |
|---|---|---|---|---|
| 3,888,400 | A | 6/1975 | Wig | |
| 4,923,139 | A | 5/1990 | Bulso, Jr. et al. | |
| 5,392,977 | A * | 2/1995 | Kato | B65H 23/042 72/8.6 |
| 5,451,011 | A | 9/1995 | Frost et al. | |
| 5,833,105 | A | 11/1998 | Stuber | |

FOREIGN PATENT DOCUMENTS

| | | | |
|---|---|---|---|
| JP | H10-5904 | A | 1/1998 |
| JP | 2004-142876 | A | 5/2004 |
| JP | 2004-143876 | A | 5/2004 |
| JP | 2011-104650 | A | 6/2011 |

OTHER PUBLICATIONS

Office Action dated Feb. 11, 2025 in corresponding Korean Application No. 10-2021-7023400 with English translation.
Office Action and Search Report dated Jan. 30, 2023 in corresponding Taiwan Application No. 109103396 with translation.
Office Action dated Oct. 3, 2023 in corresponding Japanese Application No. 2020-571187 with translation.
Office Action dated Nov. 24, 2022 in corresponding Chinese Application No. 202080009016.2 with translation.
Extended European Search Report dated Sep. 29, 2022 in corresponding application No. EP 20752809.2.
Office Action dated Mar. 1, 2024 in corresponding Japanese Application No. 2020-571187 with translation.
Office Action and Search Report dated Jun. 9, 2023 in corresponding Chinese Application No. 202080009016.2 with translation.
International Search Report (in English and Japanese) and Written Opinion (in Japanese) of the International Searching Authority issued in PCT/JP2020/003951, mailed on Apr. 7, 2020; ISA/JP.

* cited by examiner

PLATE MATERIAL SUPPLYING APPARATUS

CROSS REFERENCE TO RELATED APPLICATIONS

This application is a U.S. National Phase Application under 35 U.S.C. 371 of International Application No. PCT/JP2020/003951 filed on Feb. 3, 2020, which claims the benefit of priority from Japanese Patent Application No. 2019-018148 filed on Feb. 4, 2019. The entire disclosures of all of the above applications are incorporated herein by reference.

TECHNICAL FIELD

The present invention relates to a plate material supplying apparatus capable of supplying a plate material to a plate material feeding apparatus which intermittently transports the plate material to a press apparatus or the like.

BACKGROUND ART

When a plate material feeding apparatus transports a plate material such as a coil material to a press apparatus or the like, the transportation operation by the plate material feeding apparatus is performed intermittently so as to repeatedly move and stop the plate material according to press working in the press apparatus. An inertial force generated by moving and stopping the plate material acts on the plate material, causing the plate material to vibrate and a waving phenomenon called fluttering to occur. When such fluttering occurs, not only the plate material feeding apparatus is excessively burdened, but also the plate material is bent or scratched. Therefore, it is necessary to provide a buffer section called a looper. As a method of mitigating the fluttering of the coil material, there is a coil material supplying apparatus provided with the looper such as a U-shape or an S-shape as the buffer section. There is a problem that although the fluttering when the looper such as the U-shape or the S-shape is provided is less than that when it is not provided, the fluttering occurs when the coil material is transported at a high speed, and thus the coil material cannot be transported at a further high speed, and a pressing ability cannot be fully exerted whereas high speed is required for press working.

Patent Document 1 discloses that a coil material supplying apparatus includes a pair of sending rolls, which are arranged in the vicinity of a plate material feeding apparatus of a press apparatus and include a servomotor for sending a coil material while forming a loop, a positional sensor which detects the amount of loop of the coil material, and a control device which controls the servomotor by a signal from the positional sensor to control the amount of sending of the coil material by the sending rolls. Patent Document 2 discloses that a coil material supplying apparatus, for supplying a coil material to a plate material feeding apparatus of a press apparatus, includes a coil material supplying unit, a positional sensor which detects the amount of loop of the coil material provided on the downstream side of the coil material supplying unit, a control device which controls a servomotor by a signal from the positional sensor to control the amount of sending of the coil material by sending rolls, and a stand which holds the coil material supplying unit in a state where a mounting angle thereof is adjustable such that a supplying angle of the material can be changed according to conditions. Patent Document 3 discloses that a coil material supplying apparatus has a leveler unit which corrects and sends out a coil material and a guide unit which forms a loop of the coil material after being sent out from the leveler unit, and has another guide unit which sets a bulge of the formed loop to a desired value and forms a loop of the coil material before entering the leveler unit, wherein the leveler unit is arranged in an intermediate portion where the loop shape is inflected.

CITATION LIST

Patent Literature

PATENT DOCUMENT 1: JP-U-H6-5716
PATENT DOCUMENT 2: JP-A-2004-142876
PATENT DOCUMENT 3: JP-A-2011-104650

SUMMARY OF INVENTION

Technical Problem

In the coil material supplying apparatuses according to Patent Documents 1 to 3, since the plate material is substantially conveyed from the vertically lower side to the vertically upper side so as to oppose gravity, there is a problem that the plate material is hung down by gravity at any place where the plate material is conveyed, causing fluttering to be likely to occur. Further, when the plate material feeding apparatus intermittently transports the plate material at a high speed, there is a problem that an inertial force is generated by moving and stopping the plate material, causing the plate material to vibrate, and fluttering to be likely to occur.

Therefore, an object of the present invention is to provide a plate material supplying apparatus capable of supplying a plate material so as to mitigate the influence in the direction of gravity by conveying the plate material so as not to oppose gravity and so as to mitigate the influence of the inertia force generated by moving and stopping the plate material by the plate material feeding apparatus, in order to solve above-mentioned problems.

Solution to Problem

According to an aspect of the present invention, a plate material supplying apparatus for supplying a plate material to a plate material feeding apparatus intermittently transporting the plate material, includes an upper portion conveying the plate material substantially in a plate material feeding apparatus direction, a central portion receiving the plate material conveyed from the upper portion to convey the plate material in a diagonally vertical downward direction, and a lower portion receiving the plate material conveyed from the central portion to convey the plate material substantially in the plate material feeding apparatus direction.

According to a specific example of the present invention, the plate material supplying apparatus is provided with a space in which the plate material is capable of being retained in response to intermittent transportation of the plate material feeding apparatus.

According to a specific example of the present invention, in the plate material supplying apparatus, the space is provided between the central portion and the lower portion.

According to a specific example of the present invention, in the plate material supplying apparatus, the central portion is capable of conveying the plate material from the upper portion to the central portion at a constant speed.

According to a specific example of the present invention, in the plate material supplying apparatus, a size of the space is capable of being adjusted by adjusting a position of the central portion in the plate material supplying apparatus.

According to a specific example of the present invention, in the plate material supplying apparatus, a position of the central portion is capable of being adjusted according to at least one of a thickness of the plate material, a feed length of the plate material, and a transport speed of the plate material.

According to a specific example of the present invention, in the plate material supplying apparatus, the central portion is capable of moving in the vertical direction in order to adjust the size of the space.

According to a specific example of the present invention, in the plate material supplying apparatus, the central portion is capable of rotating about an axis which is parallel in the horizontal direction and perpendicular to the diagonally vertical downward direction in order to adjust the size of the space.

According to a specific example of the present invention, in the plate material supplying apparatus, the upper portion includes a guide for guiding the plate material to the central portion.

According to a specific example of the present invention, in the plate material supplying apparatus, the lower portion includes a guide for guiding the plate material to the plate material feeding apparatus.

Advantageous Effect of Invention

According to the present invention, the influence in the direction of gravity can be mitigated to suppress the occurrence of fluttering, and the plate material can be supplied to a working apparatus at a high speed.

Other objects, features and advantages of the present invention will become apparent from the following description of the embodiments of the present invention taken in conjunction with the accompanying drawings.

DESCRIPTION OF EMBODIMENTS

Embodiments according to the present invention will be described with reference to the drawings. However, the present invention is not limited to those embodiments.

Figure 1:
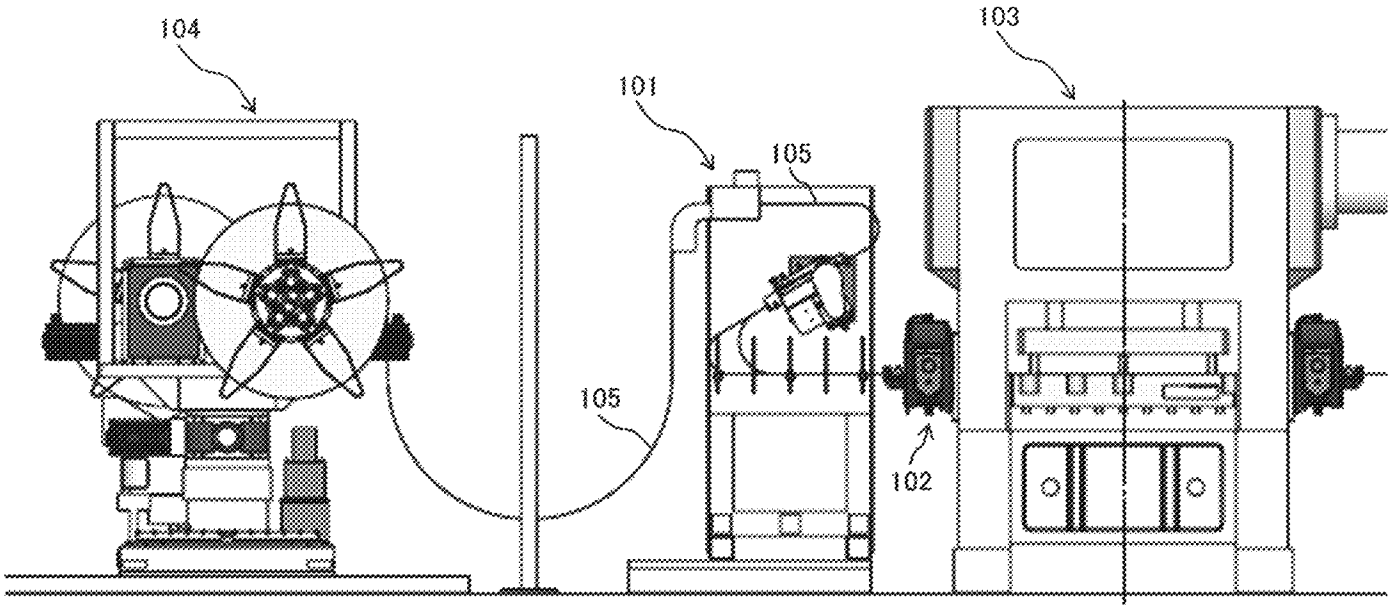
FIG. 1 is a side view of a press working line including a plate material supplying apparatus as an embodiment of the present invention.
Figure 2:
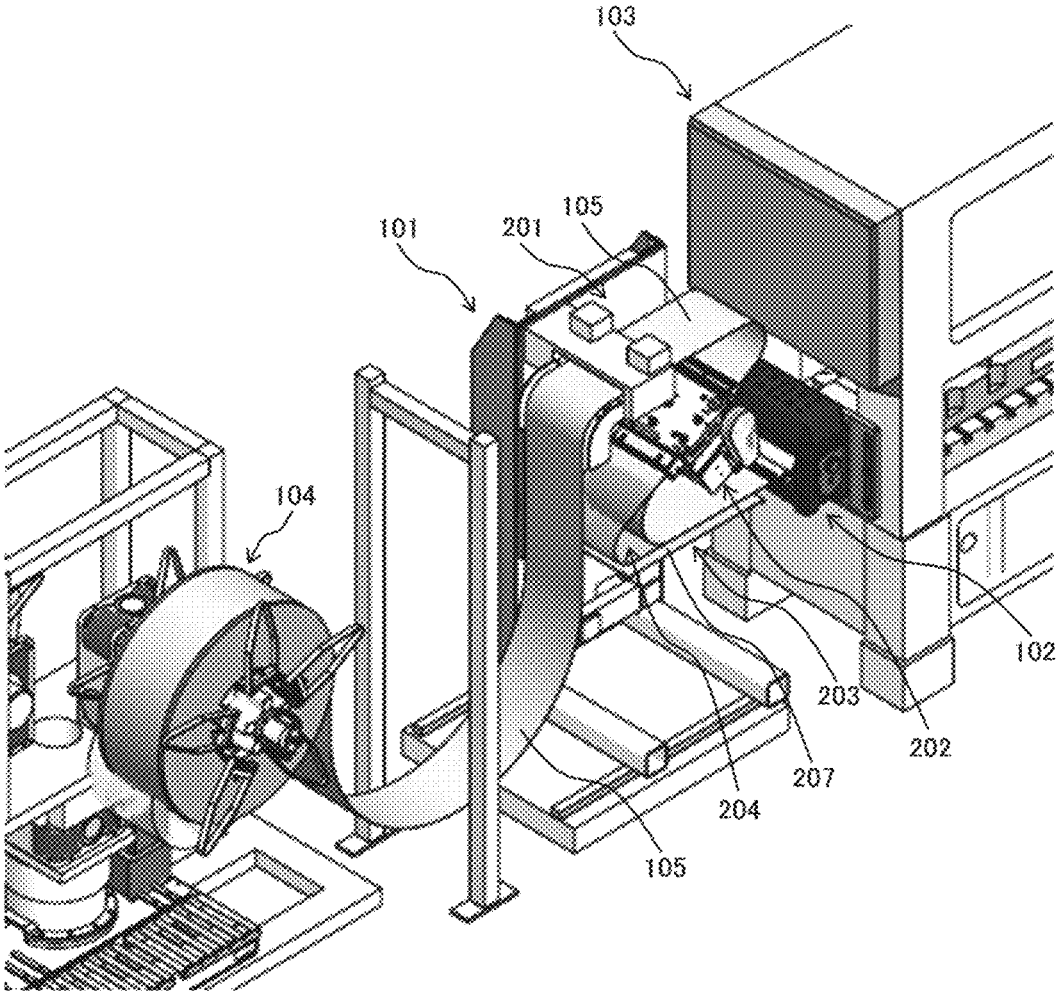
FIG. 2 is a perspective view of the press working line including the plate material supplying apparatus of FIG. 1.
Figure 3:
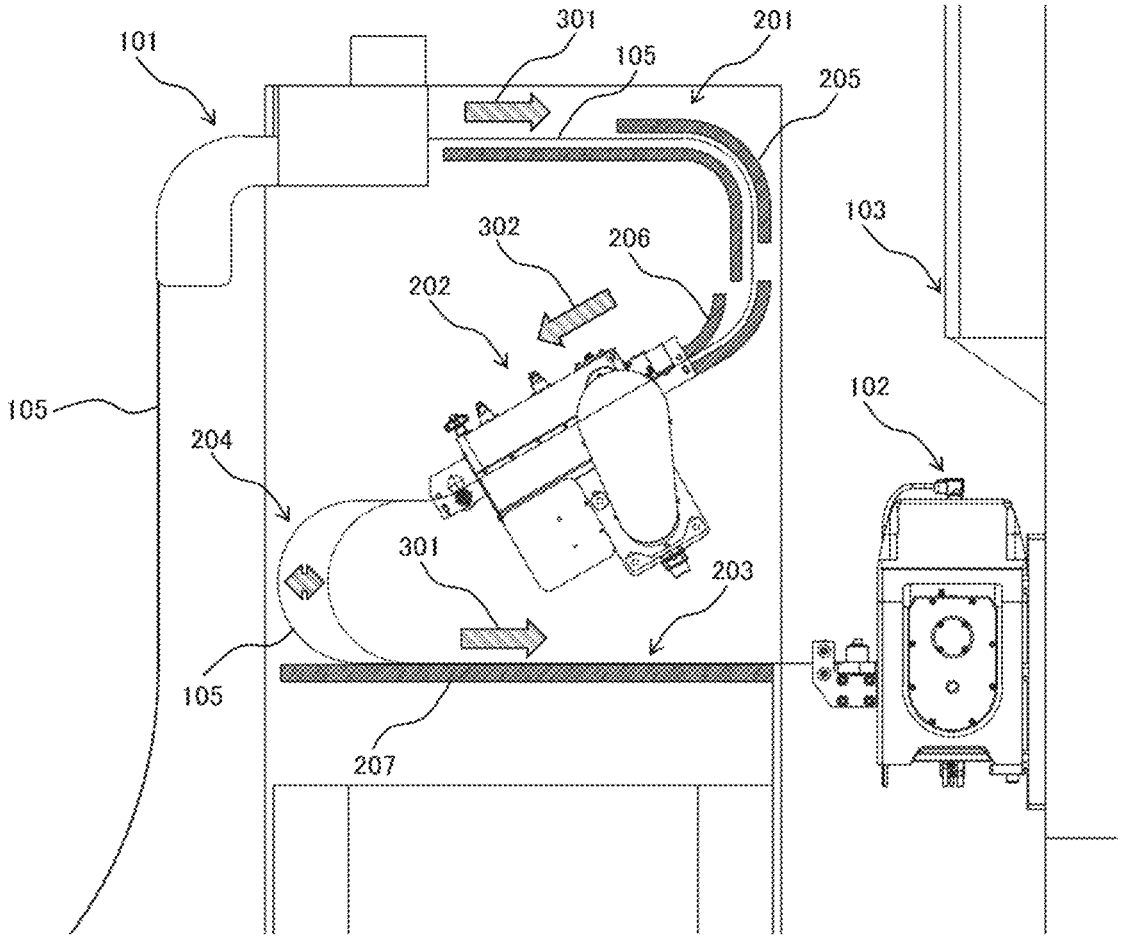
FIG. 3 is a side view of the plate material supplying apparatus of FIG. 1.
Figure 4:
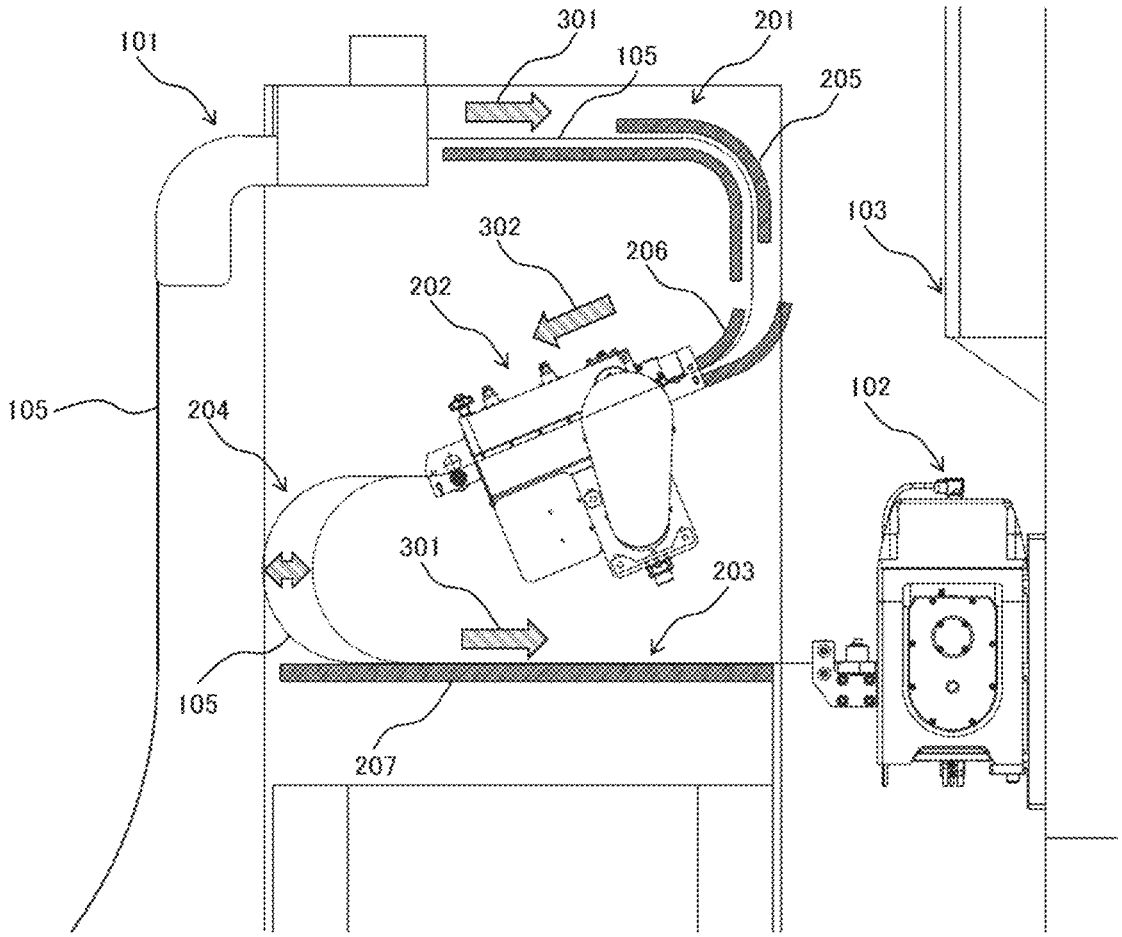
FIG. 4 is a side view of the plate material supplying apparatus in the case where a central portion is rotated in a clockwise direction with respect to the plate material supplying apparatus of FIG. 3.
Figure 5:
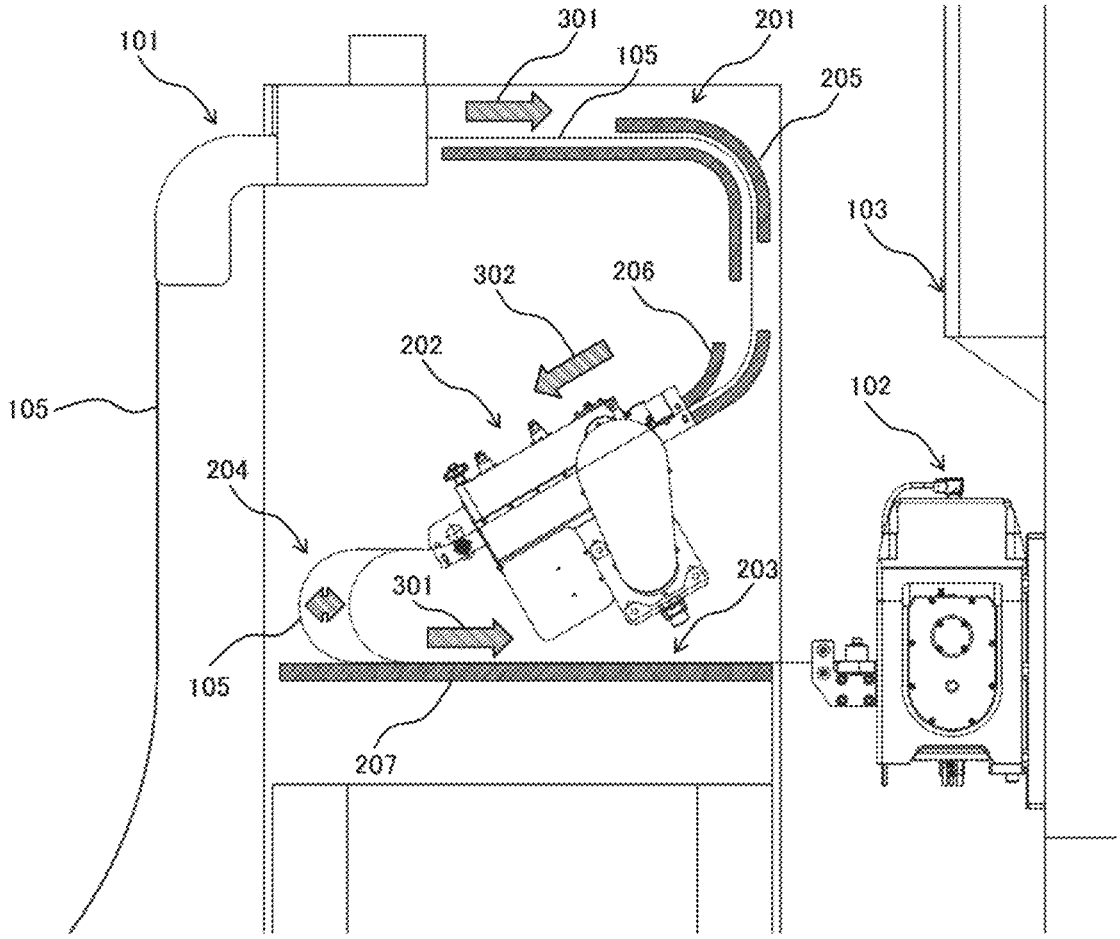
FIG. 5 is a side view of the plate material supplying apparatus in the case where the central portion is moved in the vertical downward direction with respect to the plate material supplying apparatus of FIG. 3.

A plate material supplying apparatus 101 as an embodiment of the present invention will be described with reference to FIGS. 1 to 5. As shown in FIGS. 1 and 2, in a press working line, a plate material 105 such as a coil material is conveyed from an uncoiler 104 to the plate material supplying apparatus 101, and the plate material supplying apparatus 101 supplies the plate material 105 to a plate material feeding apparatus 102 which intermittently transports the plate material 105 to a working apparatus such as a press apparatus 103 which performs processing such as press working. As shown in FIGS. 3 to 5, the plate material supplying apparatus 101 includes an upper portion 201 conveying the plate material 105 in a direction 301 towards the plate material feeding apparatus 102, a central portion 202 receiving the plate material 105 conveyed from the upper portion 201 to convey the plate material 105 in a diagonally vertical downward direction 302, and a lower portion 203 receiving the plate material 105 conveyed from the central portion 202 to convey the plate material 105 in the direction 301 towards the plate material feeding apparatus 102. Although the direction 301 towards the plate material feeding apparatus 102 is the horizontal direction in FIGS. 3 to 5, it may be substantially a direction towards the plate material feeding apparatus 102, and may be slightly inclined from the horizontal direction. For example, it may be inclined from the horizontal direction to the vertical downward direction. In the central portion 202, the plate material 105 may be substantially conveyed in the vertical downward direction. Further, in the central portion 202, as shown in FIGS. 3 to 5, the plate material 105 may be conveyed in the diagonally vertical downward direction 302 opposed to the direction 301 towards the plate material feeding apparatus 102, whereby the plate material 105 may be conveyed in the plate material supplying apparatus 101 so as to be folded back in a Z shape, and as a result, a line length of the press working line can be shortened. Further, although the plate material 105 is hung down and deformed in the direction of gravity due to its weight, in the plate material supplying apparatus 101, the plate material 105 is conveyed without being deformed by utilizing a weight of the plate material 105 itself so as not to oppose gravity. Therefore, it is possible to mitigate the influence in the direction of gravity to suppress the occurrence of fluttering, and it is also possible to speed up press working.

The plate material supplying apparatus 101 is provided with a space 204 in which the plate material 105 is capable of being retained in response to intermittent transportation of the plate material feeding apparatus 102 to the press apparatus 103. The space 204 serves as a play space for the plate material 105. The transportation operation of the plate material 105 by the plate material feeding apparatus 102 is performed intermittently so as to repeatedly move and stop the plate material 105 in accordance with press working in the press apparatus 103. Therefore, when the plate material feeding apparatus 102 moves the plate material 105 to the press apparatus 103, the plate material 105 is conveyed from the central portion 202 towards the lower portion 203 in the space 204 so as to draw a loop on the right side shown in FIGS. 3 to 5. When the plate material feeding apparatus 102 stops the movement of the plate material 105 to the press apparatus 103, the plate material 105 is retained in the space 204 and the loop drawn by the plate material 105 gradually moves to the left side towards the loop on the left side shown in FIGS. 3 to 5 according to the stop time since the plate material 105 continues to be conveyed from the central portion 202 towards the lower portion 203. The loop drawn by the plate material 105 immediately before the plate material feeding apparatus 102 starts moving the plate material 105 to the press apparatus 103 is the loop on the left side shown in FIGS. 3 to 5. When the plate material feeding apparatus 102 starts moving the plate material 105 to the press apparatus 103, the loop drawn by the plate material 105 gradually moves to the right side towards the loop on the right side shown in FIGS. 3 to 5. By providing the space 204, it is possible to mitigate the influence of an inertia force generated by moving and stopping the plate material 105 by the plate material feeding apparatus 102 to suppress the vibration of the plate material 105 and suppress the occurrence of fluttering, and it is also possible to speed up press working.

As shown in FIGS. 3 to 5, the space 204 is preferably provided between the central portion 202 and the lower portion 203. However, the space 204 is not limited to this, and depending on the configuration of the plate material supplying apparatus, it may be provided between the upper portion 201 and the central portion 202.

Figure 6:
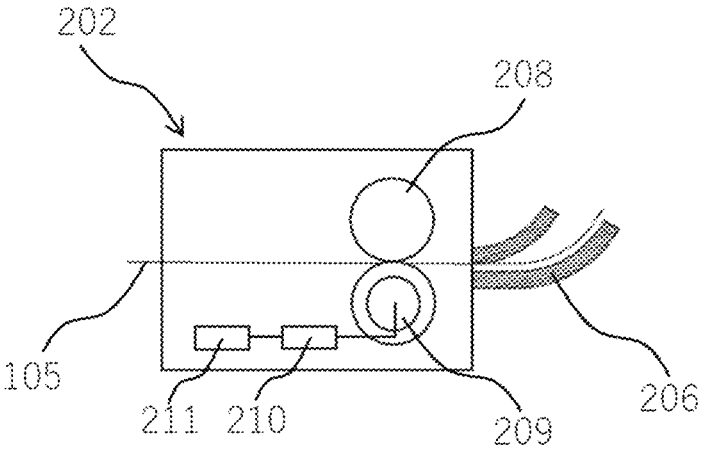
FIG. 6 is a schematic cross-sectional view of the central portion of the plate material supplying apparatus of FIG. 1.

As shown in FIG. 6, the central portion 202 may be capable of conveying the plate material 105 from the upper portion 201 to the central portion 202 at a constant speed. The central portion 202 may include a pair of rolls 208 which grip and convey the plate material 105, a servomotor 209 which rotationally drives at least one of the pair of rolls 208, a driver 210 which drives the servomotor 209, and a control device 211 which controls the servomotor 209 via the driver 210 to control the amount of conveying of the plate material 105 by the pair of rolls 208, and the pair of rolls 208 may be coupled by a coupling device such as a timing belt or a gear. In order to convey the plate material 105 at a constant speed, the control device 211 outputs a signal to the driver 210, the driver 210 rotates an output shaft of the servomotor 209 based on the signal, and the pair of rolls 208 which grip the plate material 105 rotate at a constant speed accompanied by the rotation of the output shaft of the servomotor 209 to convey the plate material 105 from the upper portion 201 to the central portion 202 at a constant speed. A distance between the pair of rolls 208 is adjusted according to a thickness of the plate material 105. However, the central portion 202 is not limited to this, as long as it can convey the plate material 105 at a constant speed. Further, the upper portion 201 may be capable of conveying the plate material 105 from the upper portion 201 at a constant speed.

A size of the space 204 for retaining the plate material 105 may be capable of being adjusted by adjusting a position of the central portion 202 in the plate material supplying apparatus 101. As shown in FIGS. 3 to 5, when the plate material 105 is conveyed from the central portion 202 towards the lower portion 203, the loop by the plate material 105 is formed in the space 204 from the central portion 202 towards the lower portion 203. However, in general, the loop radius limit of the plate material 105 when the plate material 105 forms the loop is usually up to 500 times the thickness of the plate material 105. If the loop by the plate material 105 has a loop radius equal to or less than this loop radius limit, the plate material 105 is not bent or deformed. As shown in FIGS. 3 to 5, the loop radius of the loop by the plate material 105 can be changed by changing the position of the central portion 202 in the plate material supplying apparatus 101. For example, since by changing the position of the central portion 202 in the plate material supplying apparatus 101, the loop radius of the loop by the plate material 105 can be reduced, it is possible to limit the degree of freedom of the plate material 105 to suppress the occurrence of fluttering.

A position of the central portion 202 may be capable of being adjusted according to at least one of a thickness of the plate material 105, a feed length of the plate material 105, and a transport speed of the plate material 105. For example, when the plate material 105 is thinner, the position of the central portion 202 is adjusted such that the loop radius is smaller, and when the plate material 105 is thicker, the position of the central portion 202 is adjusted such that the loop radius is larger. Further, when the feed length of the plate material 105 is shorter, the position of the central portion 202 is adjusted such that the loop radius is smaller, and when the feed length of the plate material 105 is longer, the position of the central portion 202 is adjusted such that the loop radius is larger. Further, when the transport speed of the plate material 105 is higher, the position of the central portion 202 is adjusted such that the loop radius is smaller, and when the transport speed of the plate material 105 is slower, the position of the central portion 202 is adjusted such that the loop radius is larger.

The central portion 202 may be capable of moving in the vertical direction in order to adjust the size of the space 204. As shown in FIGS. 3 and 5, by moving the central portion 202 in the vertically upward direction, the space 204 in which the plate material 105 can be retained is increased such that the loop radius can be increased, and by moving the central portion 202 in the vertically downward direction, the space 204 in which the plate material 105 can be retained is reduced such that the loop radius can be reduced. The plate material supplying apparatus 101 may include a linear motion mechanism capable of linearly moving the central portion 202 in the vertical direction. The linear motion mechanism may include, for example, an air cylinder, an electric cylinder, and the like. By linearly moving the cylinder in the vertical direction pneumatically or electrically, the central portion 202 connected to the cylinder can be linearly moved accordingly. Further, the linear motion mechanism may include a motor, a screw shaft, and a nut, and by converting a rotation of the screw shaft connected to the output shaft of the motor into a linear motion in the vertical direction by the nut, the central portion 202 connected to the nut can be linearly moved. However, the linear motion mechanism is not limited to this, as long as the central portion 202 can be moved in the vertical direction. For example, the central portion 202 may be movable in the vertical direction by manual adjustment.

The central portion 202 may be capable of rotating about an axis which is parallel in the horizontal direction and perpendicular to the diagonally vertical downward direction 302 which is a direction in which the plate material 105 is conveyed in the central portion 202 in order to adjust the size of the space 204. As shown in FIGS. 3 and 4, by rotating the central portion 202 in a clockwise direction to increase an angle in a direction in which the plate material 105 is sent out from the central portion 202 with respect to the vertically downward direction, the space 204 in which the plate material 105 can be retained is increased such that the loop radius can be increased. Further, by rotating the central portion 202 in a counterclockwise direction to reduce an angle in a direction in which the plate material 105 is sent out from the central portion 202 with respect to the vertically downward direction, the space 204 in which the plate material 105 can be retained is reduced such that the loop radius can be reduced. The plate material supplying apparatus 101 may include a rotary motion mechanism capable of rotating the central portion 202. The rotary motion mechanism may, for example, include a motor or the like, and by rotating an output shaft of the motor around an axis which is parallel to the horizontal direction and perpendicular to the diagonally vertical downward direction 302, the central portion 202 connected to the output shaft can be rotated accordingly. Further, the rotary motion mechanism may include a speed reducer. However, the rotary motion mechanism is not limited to this, as long as the central portion 202 can be rotated. For example, the central portion 202 may be rotatable about an axis which is parallel to the horizontal direction and perpendicular to the diagonally vertical downward direction 302 by manual adjustment.

The upper portion 201 may include a guide 205 at least in part in order to guide the plate material 105 to the central portion 202. It is possible to suppress the occurrence of fluttering by the guide 205. Although in FIGS. 3 to 5, there are places where the guides 205 are provided on both sides of the plate material 105, the guide 205 may be provided on only one side of the plate material 105, if necessary.

The central portion 202 may include a guide 206 at least in part in order to guide the plate material 105 into the inside of the central portion 202. It is possible to suppress the occurrence of fluttering by the guide 206. Although in FIGS. 3 to 5, the guides 206 are provided on both sides of the plate material 105, the guide 206 may be provided on only one side of the plate material 105, if necessary. Further, the guides 206 may be gradually widened towards the upper portion 201 such that the plate material 105 conveyed from the upper portion 201 can be received. By widening the guides 206, the plate material 105 can be received even when the central portion 202 is rotated as described above. Further, the guide 206 may be capable of adjusting an angle of protrusion from the central portion 202 according to the angle at which the central portion 202 is rotated.

The lower portion 203 may include a guide 207 at least in part in order to guide the plate material 105 to the plate material feeding apparatus 102. It is possible to suppress the occurrence of fluttering by the guide 207. Although in FIGS. 3 to 5, the guide 207 is provided only on the lower surface of the plate material 105, the guides 207 may be provided on both sides of the plate material 105, if necessary.

By using the plate material supplying apparatus 101 of the present invention as described above, it is possible to mitigate the influence in the direction of gravity and the influence of the inertial force generated by moving and stopping the plate material 105 by the plate material feeding apparatus 102 and supply the plate material 105 to the plate material feeding apparatus 102 which intermittently transports the plate material 105 to the working apparatus such as the press apparatus 103 so as suppress the occurrence of fluttering, suppress the vibration of the plate material 105, and speed up processing such as press working. Then, the working apparatus such as the press apparatus 103 can perform processing such as press working to the plate material 105 intermittently transported at a high degree of accuracy from the plate material feeding apparatus 102 to manufacture structures such as small parts used for an information-related device such as a mobile phone or a personal computer, or other components such as automobiles, industrial motor parts, or home appliances.

It should be further understood by those skilled in the art that although the foregoing description has been made on embodiments of the present invention, the present invention is not limited thereto and various changes and modifications may be made without departing from the principle of the present invention and the scope of the appended claims.

REFERENCE SIGNS LIST

101 plate material supplying apparatus
102 plate material feeding apparatus
103 press apparatus
104 uncoiler
105 plate material
201 upper portion
202 central portion
203 lower portion
204 space
205 guide
206 guide
207 guide
301 plate material feeding apparatus direction
302 diagonally vertical downward direction

The invention claimed is:

1. A plate material supplying apparatus for supplying a plate material to a plate material feeding apparatus intermittently transporting the plate material, the plate material supplying apparatus comprising:

an upper portion comprising a L-shaped guide, wherein by the guide of the upper portion, the plate material is guided to be conveyed in a vertical downward direction after conveyed in a horizontal direction or a direction downwardly inclined from the horizontal direction towards the plate material feeding apparatus in order not to make the plate material oppose gravity;

a central portion located vertically below the upper portion, wherein the central portion comprises a guide widened towards the guide of the upper portion, separated from the guide of the upper portion, and receiving the plate material conveyed in the vertical downward direction away from the guide of the upper portion, a pair of rolls gripping the plate material guided by the guide of the central portion, a servomotor rotationally driving at least one of the pair of rolls at a constant speed, a driver driving the servomotor, and a control device controlling the servomotor via the driver to control the amount of conveying of the plate material by the pair of rolls, such that the pair of rolls convey the plate material guided by the guide of the central portion at a constant speed in a diagonally vertical downward direction opposite to the plate material feeding apparatus; and a lower portion located vertically below the central portion, the lower portion receiving the plate material conveyed from the central portion to convey the plate material towards the plate material feeding apparatus, wherein the plate material supplying apparatus is provided with a space in which the plate material is retained in response to intermittent transportation of the plate material feeding apparatus, the space being provided only between the central portion and the lower portion, and in order not to make the plate material oppose gravity, the plate material is conveyed in the horizontal direction or a direction downwardly inclined from the horizontal direction in the lower portion.

2. The plate material supplying apparatus according to claim 1, wherein a size of the space is adjusted by adjusting a position of the central portion in the plate material supplying apparatus.

3. The plate material supplying apparatus according to claim 1, wherein a position of the central portion of the plate material supplying apparatus is adjusted according to at least one of a thickness of the plate material, a feed length of the plate material, and a transport speed of the plate material.

4. The plate material supplying apparatus according to claim 1, wherein the central portion moves in a vertical direction in order to adjust a size of the space.

5. The plate material supplying apparatus according to claim 1, wherein the central portion rotates about an axis which is parallel in the horizontal direction and perpendicular to the diagonally vertical downward direction in order to adjust a size of the space.

6. The plate material supplying apparatus according to claim 1, wherein the lower portion comprises a guide for guiding the plate material to the plate material feeding apparatus.

* * * * *